US006676762B2

(12) United States Patent
Drzal et al.

(10) Patent No.: US 6,676,762 B2
(45) Date of Patent: Jan. 13, 2004

(54) METHOD FOR CLEANING A FINISHED AND POLISHED SURFACE OF A METAL AUTOMOTIVE WHEEL

(75) Inventors: Lawrence T. Drzal, Okemos, MI (US); Richard L. Schalek, Haslett, MI (US)

(73) Assignee: Board of Trustees of Michigan State University, East Lansing, MI (US)

( * ) Notice: Subject to any disclaimer, the term of this patent is extended or adjusted under 35 U.S.C. 154(b) by 184 days.

(21) Appl. No.: 09/761,090

(22) Filed: Jan. 15, 2001

(65) Prior Publication Data

US 2002/0129833 A1 Sep. 19, 2002

(51) Int. Cl.[7] ..... B08B 7/00

(52) U.S. Cl. ..... 134/1; 134/2; 134/25.4; 134/30; 134/32; 134/37; 134/42; 134/902

(58) Field of Search ..... 134/1, 2, 25.4, 134/30, 32, 37, 42, 902

(56) References Cited

U.S. PATENT DOCUMENTS

| | | | | |
|---|---|---|---|---|
| 3,890,176 A | | 6/1975 | Bolon | |
| 4,035,895 A | * | 7/1977 | Lester | 29/447 |
| 4,717,516 A | | 1/1988 | Isaka et al. | |
| 4,756,765 A | | 7/1988 | Woodroffe | |
| 4,803,021 A | | 2/1989 | Werth et al. | |
| 4,810,434 A | | 3/1989 | Caines | |
| 4,867,796 A | | 9/1989 | Asmus et al. | |
| 5,019,210 A | | 5/1991 | Chou et al. | |
| 5,098,618 A | | 3/1992 | Zelez | |
| 5,281,798 A | | 1/1994 | Hamm et al. | |
| 5,357,005 A | | 10/1994 | Buchwalter et al. | |
| 5,500,459 A | | 3/1996 | Hagemeyer et al. | |
| 5,512,123 A | | 4/1996 | Cates et al. | |
| 5,749,975 A | * | 5/1998 | Li et al. | 134/1 |

FOREIGN PATENT DOCUMENTS

| | | |
|---|---|---|
| GB | 723631 | 2/1955 |

OTHER PUBLICATIONS

Vig, John R., Reseach and Development Technical Report SLCET–TR–91–33, U.S. Army Electronics Technology and Devices Laboratory, Jan. 1992, pp. 1–28.*

Bolon et al., Polymer Engineering and Science, vol. 12, pp. 109–111 (1972).

M.J. Walzak et al., Poly. Surface Mod.: Revelance to Adhesion, pp. 253–272 (1995).

Strobel et al., Journal of Adhesion Sci & Tech pp. 365–383 (1995).

N. Dontula et al., Proc. of 20th Ann. Adhesion Soc. Mtg., Hilton Head, SC (1997).

C.L. Weitzsacker et al., Utilizing X–ray Photo–)electron Spect. to Investigate Modified Polymer) Surfaces: Proc. of 20th Ann. Adhesion Soc.) Meeting, Hilton Head, SC (1997)).

N. Dontula et al., Ultraviolet Light as an) Adhesive Bonding Surface Pretreatment for) Polymers and Polymer Composites, Proc. of) ACCE'97, Detroit, MI).

C.L. Weitzsacker et al., Surface Pretreatment of) Plastics and Polymer Comp. Using UV Light, ) Proc. of ACT'97, Detroit, MI.

N. Dontula et al., Surface Activation of Poly. Using UV Activation, Proc. of Soc. of Plastics Engineers ANTEC'97, Toronto, Canada.

Haack, L.P., et al., 22nd Adhesion Soc. Mtg. (Feb. 22–24, 1999.

Experimental Methods in Photochemistry, Chap. 7, pp. 686–705 (1982).

* cited by examiner

*Primary Examiner*—Zeinab El-Arini
(74) *Attorney, Agent, or Firm*—Ian C. McLeod

(57) ABSTRACT

A method using irradiation of substrates (12) with ultra violet light to remove a surface contaminant is described. The light can be pulsed or continuous. The treated surfaces are more paintable and bondable.

6 Claims, 5 Drawing Sheets

METHOD FOR CLEANING A FINISHED AND POLISHED SURFACE OF A METAL AUTOMOTIVE WHEEL

CROSS-REFERENCES TO RELATED APPLICATIONS

None

STATEMENT REGARDING FEDERALLY SPONSORED RESEARCH OR DEVELOPMENT

None

BACKGROUND OF THE INVENTION

1. Field of the Invention

The present invention relates to a method for cleaning surfaces of a surface finished article of manufacture to remove contaminants using continuous ultraviolet light and ozone. In addition, the combination of ozone and UV light can be used to remove the contaminants from the surface. The treatment enhances surface activation, allows for surface cleaning in short time periods and increases the wetting characteristics of the surface.

2. Description of Related Art

Surfaces of articles of manufacture always contain undesirable organic contaminant materials that prevent binding to the surfaces and which particularly reduce adhesion of a paint or film to the surfaces. Hence, surface preparation, which includes cleaning of the surfaces, of polymeric, polymer composite or metal substrates, to remove the organic contaminants is carried out prior to applying protective paint films or adhesive bonding. Surface preparation determines the mechanical and durability characteristics of the layered composite created. Currently the techniques used for surface preparation are mechanical surface treatments (e.g. abrasion), solvent wash and chemical modification techniques like corona, laser plasma, flame treatment and acid etching. Each of the existing processes have shortcomings and thus, they are of limited use. Abrasion techniques are found to be time consuming, labor intensive and have the potential to damage the adherent surface. Use of organic solvents results in volatile organic chemical (VOC) emissions. Chemical techniques are costly, are of limited use with regard to treating three dimensional parts, can be limited to a batch process (such as plasma, laser and acid etching) and need tight control.

The focused beams of the lasers make it difficult to treat a large surface. U.S. Pat. No. 4,803,021 to Werth et al describes such a method. U.S. Pat. No. 4,756,765 to Woodroffe describes paint removal with surface treatment using a laser.

Plasma treatment of surfaces requires relatively expensive equipment and the plasmas are difficult to control. The surfaces are treated with vaporized water in the plasma. Illustrative of this art are U.S. Pat. Nos. 4,717,516 to Isaka et al., 5,019,210 to Chou et al., and 5,357,005 to Buchwalter et al.

A light based process which cleans a substrate surface also creates a beneficial chemistry on the surface for adhesive bonding and paintability is described in U.S. Pat. No. 5,512,123 to Cates et al. The process involves exposing the desired substrate surface to be treated to flashlamp radiation having a wavelength of 160 to 5000 nanometers. Ozone is created from oxygen in the air by the short wavelength UV light or may be added with an ozone generator and combined with the UV light to increase the surface energy and wettability of the surface of the substrate being treated. Surfaces of substrates such as metals, polymers, polymer composites are cleaned by exposure to the flashlamp radiation. The problem with the Cates et al process is that the surface of the substrate is heated to a relatively high temperature, particularly by radiation above 500 nanometers and relatively long treatment times. Related patents to Cates et al are U.S. Pat. Nos. 3,890,176 to Bolon, 4,810,434 to Caines; 4,867,796 to Asmus et al; 5,281,798 to Hamm et al and 5,500,459 to Hagemeyer et al and U.K. Patent No. 723,631 to British Cellophane. Non-patent references are: Bolon et al., "Ultraviolet Depolymerization of Photoresist Polymers", Polymer Engineering and Science, Vol. 12 pages 109–111 (1972). M. J. Walzak et al., "UV and Ozone Treatment of Polypropylene and poly(ethylene terephthalate)", In: Polymer Surface Modification: Relevance to Adhesion, K. L. Mittal (Editor), 253–272 (1995); M. Strobel et al., "A Comparison of gas-phase methods of modifying polymer surfaces", Journal of Adhesion Science and Technology, 365–383 (1995); N. Dontula et al., "A study of polymer surface modification using ultraviolet radiation", Proceedings of 20th Annual Adhesion Society Meeting, Hilton Head, S.C. (1997); C. L. Weitzsacker et al., "Utilizing X-ray photoelectron spectroscopy to investigate modified polymer surfaces", Proceedings of 20th Annual Adhesion Society Meeting, Hilton Head, S.C. (1997); N. Dontula et al., "Ultraviolet light as an adhesive bonding surface pretreatment for polymers and polymer composites", Proceedings of ACCE'97, Detroit, Mich.; C. L. Weitzsacker et al., "Surface pretreatment of plastics and polymer composites using ultraviolet light", Proceedings of ACT'97, Detroit, Mich.; N. Dontula et al., "Surface activation of polymers using ultraviolet activation", Proceedings of Society of Plastics Engineers ANTEC'97, Toronto, Canada. Haack, L. P., et al., 22nd Adhesion Soc. Meeting (Feb. 22–24, 1999).

Non-pulsed UV lamps have been used by the prior art. These are described in: "Experimental Methods in Photochemistry", Chapter 7, pages 686–705 (1982). U.S. Pat. No. 5,098,618 to Zelez is illustrative of the use of these types of lamps with a low wattage input.

There is a need for development of an environmentally friendly, as well as cost effective and robust surface treatment process for removing mold organic material contaminants from surfaces.

OBJECTS

It is therefore an object of the present invention to provide a process which is reliable and which cleans surfaces of organic material contaminants. It is further an object of the present invention to provide a process which is rapid and economical. These and other objects will become increasingly apparent by reference to the following description and the drawings.

SUMMARY OF THE INVENTION

The present invention relates to a method for cleaning a finished surface of an article of manufacture which comprises:

exposing a contaminant on the surface to ultraviolet light in either continuous or pulsed form, to volatilize the organic material and thereby clean the surface without damaging the finished material surface. The wattage input to the lamp is between about 0.5 and 20 kW to provide continuous or pulsed light.

The substance and advantages of the present invention will become increasingly apparent by reference to the following drawings and the description.

DESCRIPTION OF THE PREFERRED EMBODIMENTS

Figure 1:
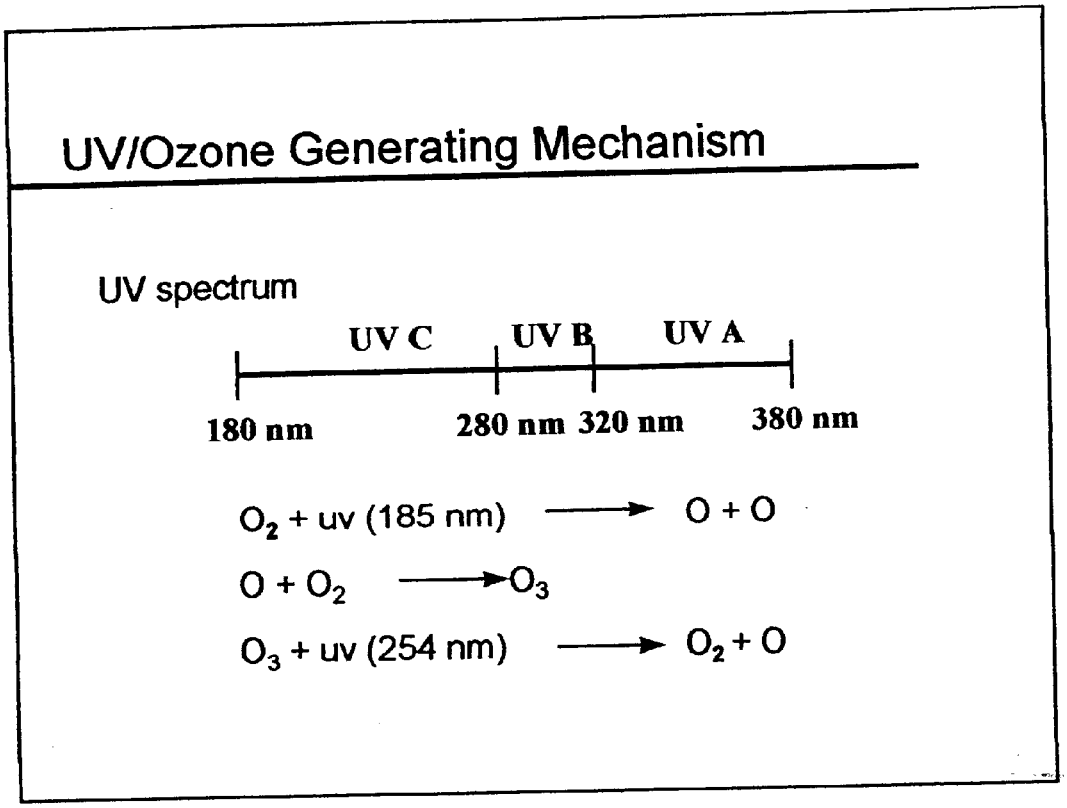
FIG. 1 is a schematic of UV light-oxygen interactions which generate atomic oxygen.

During the past 15 years there has been an increase of 15 to 20% in the mass of automobiles. This increased weight resulted in an increase in fuel consumption ranging from 6 to 10% while maintaining comparable car performance. The reasons for the increased mass include the addition of new features, improved safety and security, improved vibrational/acoustical comfort, and improved reliability. This trend will continue as the automobile industry strives to meet consumers' continuously growing demands. For this reason, it is important to identify the ways of reducing mass by demonstrating the applicability of new, lighter-weight materials from technical, as well as economic viewpoints. Because of these factors all car makers have initiated weight reduction programs with the purposes to reduce fuel consumption and emissions while reducing the fatigue of assembly line workers in the handling of items.

Metals that have been identified as weight reduction replacements for currently used automotive materials are aluminum and magnesium alloys and ultra-high strength steels. Aluminum and magnesium alloys are increasingly used in the automobile industry because of their exceptional properties, including lightweight (⅔ times that of aluminum), good strength-to-weight ratio, good low-cost machineability and weldability. These alloys are also able to dampen shock waves and have excellent hot forming properties and good dimensional stability. Typical automotive magnesium die castings include cylinder head covers, clutch housings, instrument panels, and wheels.

Though steel is approximately 4 times the density of magnesium and approximately 3 times the density of aluminum, recent efforts in developing ultra-high strength steel (tensile strength >500 MPa) permits part fabrication using thinner gauges which effectively reduce the overall weight. Combining this with a current cost differential of approximately $1.00 per pound between steel and aluminum, and the highest recycling rate, indicates that steel will be maintained as a significant automotive material in the foreseeable future. Evidence of this is provided by the global steel industry's UltraLight Auto Body (ULSAB) project whose aim is to improve the quality of available steel. Recently, the ULSAB project assembled a body-in-white test unit consisting of 90% high- and ultra-high strength steel.

The native oxide layer that forms on aluminum and magnesium alloys is mechanically very weak. In fact, unprotected magnesium surfaces can become unstable from exposure to the air in a shop environment or corrode in shipment from manufacturer to the end user. Attempts to protect the surface from corrosion include surface application of messier oils or dichromate coatings and the use of desiccant packages to absorb moisture. Before bonding removal of these corrosion or organic coatings requires a chemical etch and/or primer treatment to ensure adequate joint strength.

In selecting a metal cleaning process, many factors must be considered (Knipe, R., Advanced Materials and Processes 8 23–25 (1997)). The two most important considerations are the nature of the contaminant to be removed and the substrate that is to be cleaned. There are many types of contaminants that can soil the surface of a part. These include pigmented drawing compounds, unpigmented oil and grease, chips and cutting fluids, polishing and buffing compounds, rust and scale, and miscellaneous surface contaminants such as lapping compounds. Magnesium alloys are typically cleaned using alkaline solutions with Ph values up to 11 since the resistance to acid attack is weak (Smith, W. F., Structure and Properties of Engineering Alloys, McGraw-Hill, New York, N.Y. (1993)). Similarly, steels are highly resistant to alkalis and attacked by essentially all acidic material. Most of these contaminants are removed using solvent or by an aqueous method. High impact dry media cleaning can be used to remove rust and scale. In either case the waste product and safety concerns that must be addressed.

Other factors that must be considered when choosing a cleaning process are the environmental impact of the process, cost considerations and capital expenses, and surface requirements of subsequent operations such as phosphate conversion coating, painting or plating.

The dynamic photochemical interactions between UV radiation, ozone and air are complicated, and are not completely understood, but have been extensively studied (Calver, J. G., et al., Photochemistry, John Wiley, New York, N.Y. (1966)). A low-pressure mercury discharge lamp emits UV radiation in the wavelength range of 180 nm to ~400 nm with strong wavelength emissions at 254.5 nm and 185 nm. These two wavelengths correspond to energies of 458 kJ/mol for the 254.5 nm radiation and 644 kJ/mol for the 185 nm radiation. Wavelengths in the visible and infrared region are also present. The mechanisms for ozone formation and destruction in the presence of UV light can be illustrated as depicted in FIG. 1. Here atomic oxygen is generated by the photo dissociation of $O_2$ after absorbing 185 nm wavelength radiation. The atomic oxygen then reacts with the diatomic oxygen to form ozone, which can then absorb 253.7 nm radiation and decompose into atomic and diatonic oxygen. Thus one role of the 185 nm light in the cleaning process is to create ozone and atomic oxygen molecules from diatomic oxygen. At normal atmospheric pressure, the steady-state concentration of $O_3$ is much larger than the concentration of atomic oxygen. Hydroxyl radicals may also form under these conditions by reaction of ozone and/or atomic oxygen with water vapor.

Table 1 shows the photon energies associated with UV radiation are in the same range as the bond dissociation energies of common covalent bonds in organic molecules.

TABLE 1

Common Bond Energies

| Bond Type | Bond Energy (KJ/mol) |
|---|---|
| C—C | 370 |
| C═C | 680 |
| C≡C | 890 |
| C—H | 435 |
| C—N | 305 |
| C—O | 360 |
| C═O | 535 |
| C—F | 450 |
| C—Cl | 340 |
| O—H | 500 |
| O—O | 220 |
| O—Si | 375 |
| N—H | 430 |
| N—O | 250 |
| F—F | 160 |

The role of the 254 nm UV light contributes more to the cleaning process since it interacts more efficiently with a wide variety of organic molecules. Furthermore, organic materials with chromophores such as carbonyl groups and unsaturated centers can absorb even longer wavelengths of UV radiation. Similar to the UV radiation induced reactions of gases, the light induced degradation of organic solids rarely proceeds by a direct photolysis of the covalent bonds, but proceeds through complex reactions involving excitation, energy transfer, and oxidation.

The absorption of a photon by a hydrocarbon molecule creates a short-lived electronically excited state. The excited state might decompose, it might polymerize with other surface organics, or it might oxidize in the presence of oxygen. The 254 nm UV light has been shown to exhibit some cleaning action itself, but the combination of UV light with ozone present greatly enhances the cleaning effectiveness of the process (Vig, J. R., et al., J. Vacuum Sci. Technol., A3 1027–1034 (1985)).

The UV generated atomic oxygen is a free radical and reacts with all organic material to form $CO_2$ and $H_2O$. While the gas phase concentration of atomic oxygen is small, most (if not all) of the oxidation processes occur while the organic is attached to the surface. Dissociation of ozone on the surface could lead to chemically significant concentrations of adsorbed atomic oxygen on the surface. Reaction of this oxygen with surface hydrocarbon may be an important mechanistic pathway in the cleaning process. The surface itself might be acting as a catalyst for the cleaning reaction, as it allows adsorbed oxygen and hydrocarbon to come into contact with each other. Exposed metal sites may be necessary to dissociatively adsorb the ozone and generate atomic oxygen. Additionally, the 254 nm light may be enhancing the surface dissociation of $O_3$, in addition to (or instead of) enhancing the reactivity of the hydrocarbon.

As Table 2 shows, the adsorption of energetic UV radiation, in the wavelength range of 180 to 400 nm by organic contaminants on metal surfaces results in chemical bond breaking of surface molecules (Carey, F. A., et al., Advanced Organic Chemistry: Part A Structure and Mechanisms, Plenum Press, New York, N.Y. (1997)).

TABLE 2

UV Absorption of Various Organic Materials

| Type of Organic | Absorption Maxima (nm) |
|---|---|
| Simple Alkanes | 190–200 |
| Alicyclic Dienes | 220–250 |
| Cyclic Dienes | 250–270 |
| Styrenes | 270–300 |
| Saturated Ketones | 270–280 |
| α,β-Unsaturated Ketones | 310–330 |
| Aromatic Ketones and Aldehydes | 280–300 |
| Aromatic Compounds | 250–280 |

The UV/ozone cleaning process, using a pulsed or continuous light source and in combination with an oxidizing gas, dissociates chemical bonds of the surface contamination film and particles without affecting the base material. This suggests that the UV/ozone technique has the potential for removing metallic ions, organic films and oxides. Though the irradiation system operates at room temperature and ambient pressure, the infrared wavelength portion of the radiation combined with focusing optics of the lamp can cause large, local, increases in surface temperature in thin or non conducting parts which may cause ejection of particles with sizes less than 1 $\mu$m. High thermal conductivity and large thermal mass protects the part from localized melting or microroughening.

The strength of a bonded joint (welded or liquid adhesive) is determined by the physical, mechanical, and chemical properties of the adhesive-metal surface (Kinloch, A. J., Adhesion and Adhesives: Science and Technology, Chapman and Hall, New York, N.Y. (1987)). The first step in the formation of an adhesive bond is the establishment of interfacial molecular contact by wetting. A convenient way to quantify the degree of wetting is to measure the contact angle of a deionized water droplet placed on the material surface. Since the work of adhesion is proportional to the cosine of the contact angle, the adhesive bond strength increases as the contact angle decreases.

The surface energy of the metal is determined by its outermost surface composition and chemistry, whether it is an oxide film, lubricant or applied pretreatment. The pertinent property of the oxide is its crystal structure (or lack of it), including its degree of hydration (Chalk, D. B., Classification and Selection of Cleaning Processes, in ASM Handbook: Surface Engineering, ASM International). In addition to the oxides, there will be water (both adsorbed and chemically bound) and various contaminants including adsorbed organic material, which are hard to control in industrial atmospheres. The contamination of the metal surface occurs because low-energy organic materials adsorb onto high-energy metallic surfaces to minimize total surface energy of the system. This adsorbed film, even if a single molecular layer thick, adversely affects the wettability of the metal and becomes a weak boundary layer that decreases the bond strength.

Preferably, the surface of the substrate with the organic contaminant is exposed to a UV flashlamp emitting the radiation in the wavelength range (180 nm–500 nm). The mold surface to be treated is preferably constructed of a polymer, polymer composite or a metal. Process times are regulated by the distance of the UV lamp from the substrate surface, ambient temperature or condition and the extent of surface modification needed. The distance of the UV lamp from the substrate surface determines the intensity of UV radiation at the surface substrate. Ambient conditions are important depending on whether air, nitrogen or ozone are present. Surface modifications are characterized using contact angle measurements which are done using a Rame-Hart goniometer apparatus with deionized water.

Figure 2:
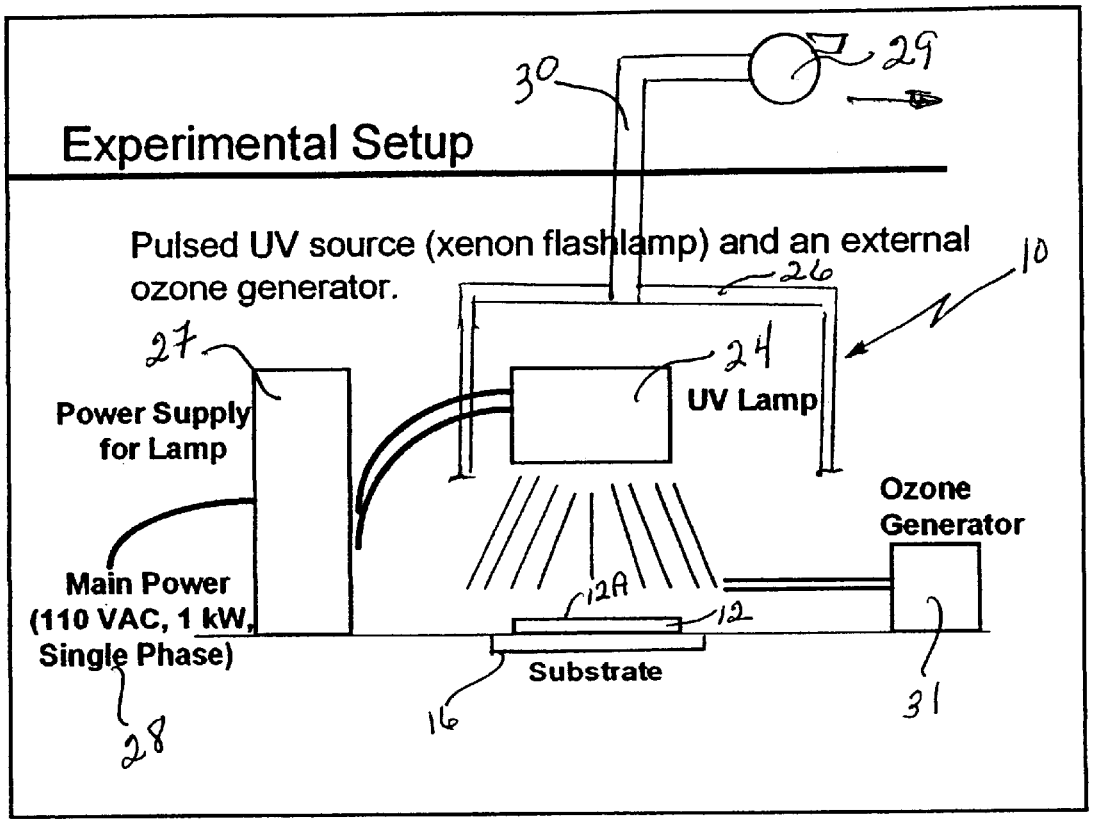
FIG. 2 is a schematic diagram of the apparatus 10 used in the present invention to treat an article of manufacture 12 with ozone and UV light.

The process can also be used in a continuous process. Either the substrate or the lamps can be moving. FIG. 2 shows a preferred system 10 of the present invention for irradiating a substrate 12 with a mold release agent on it. The substrate 12 is preferably provided on a conveyor belt 16. The belt 16 moves out from the page as shown. Initially the substrate 12 is placed on the conveyor belt 16. The surface 12A is irradiated with UV light from a lamp 24 mounted in a hood 26 which is opaque to the light to prevent eye damage. The lamp 24 is controlled by a pulse modulator 27 and operated by a power supply 28. The hood 26 is provided with a blower 29 which removes volatilized products from the hood 26 through line 30.

In the following Example 3, a continuous ultraviolet lamp from Fusion (FS600) was used. It had a power input of 6 kW. The other variables that play a role in the extent of modification of the substrate surfaces by UV are: distance of lamp from the substrate surface (d), exposure time (t), effect of humidity surrounding the substrate, intensity of lamp radiation, presence of UV stabilizers in the substrate, the nature of the substrate surface and cooling of the surface.

An external ozone generator 31 (Ozotech, Eureka, Calif. 96097) was used to increase the concentration of ozone over the substrate 12 surface over what is generated in air by the UV light. The ozone flow rate used during experimentation was 30 std.cu.ft./hr. The other variables were the time of exposure, the distance between the sample and the UV source.

The experiments show that the treatment enhances the substrate's surface wettability, with the degree of enhancement depending on the substrate characteristics and the treatment processing conditions used. The substrates are characterized prior to and after UV treatment using contact angle measurements to determine wettability. X-ray photoelectron spectroscopy (XPS) and Fourier transform infrared spectroscopy with the attenuated total reflectance (FTIR-ATR) setup is used to characterize the surface chemical composition of the substrates. Atomic force microscopy (AFM) is used to characterize and compare the control substrate surfaces with the UV treated surfaces. Also, environmental scanning electron microscopy (ESEM) is used to determine the effect initial substrate morphology has on UV treatment. Adhesion measurements have been conducted using a pneumatic adhesion tensile testing instrument.

On exposure to various treatments the substrates were characterized for wettability, surface chemical composition, morphology and stability. Wettability was determined by measuring contact angles of de-ionized water using the Rame-Hart goniometer apparatus. Except where specified, the contact angles (θ) were measured immediately after UV exposure. At least ten measurements of contact angles were taken for each sample and the averages are reported here.

Environmental scanning electron microscopy (ESEM) was also used to characterize surface morphology prior to and after UV treatment. Also, ESEM was used to determine if there was any relationship between extent of modification and initial morphology of the substrate. The ESEM used for the morphological study was an Electroscan 2020 (Phillips Inc.).

In the following Examples the contaminants are removed. The following Experiments show the cleaning of aluminum 1100 and 356.

COMPARATIVE EXAMPLES 1 AND 2

Figure 3A:
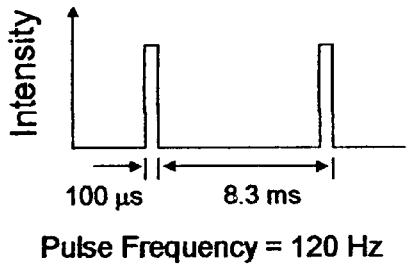
FIGS. 3A and 3B are schematic diagrams showing the output of a pulsed UV source (Xenon RC-500™ 300 watts, low power) and a continuous source™ (Fusion FS-600™, 6 kW high power).
Figure 4:
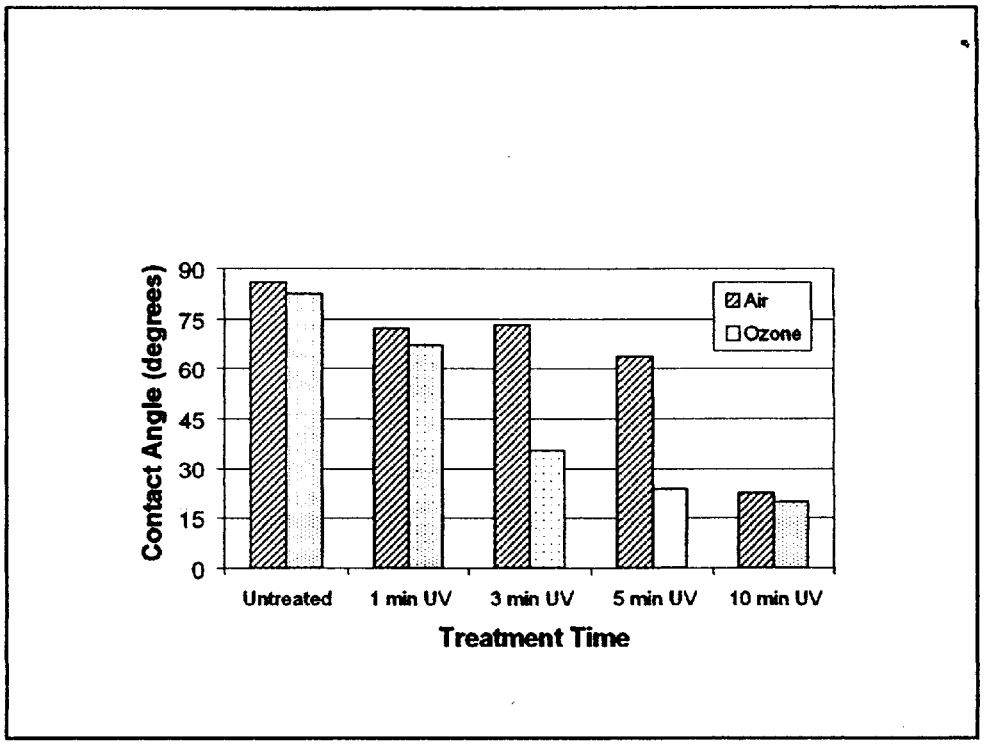
FIG. 4 is a graph showing time of UV treatment of a finished surface of Aluminum 1100 with and without ozone with a Xenon RC-500 lamp (low power ~0.5 KW).
Figure 5:
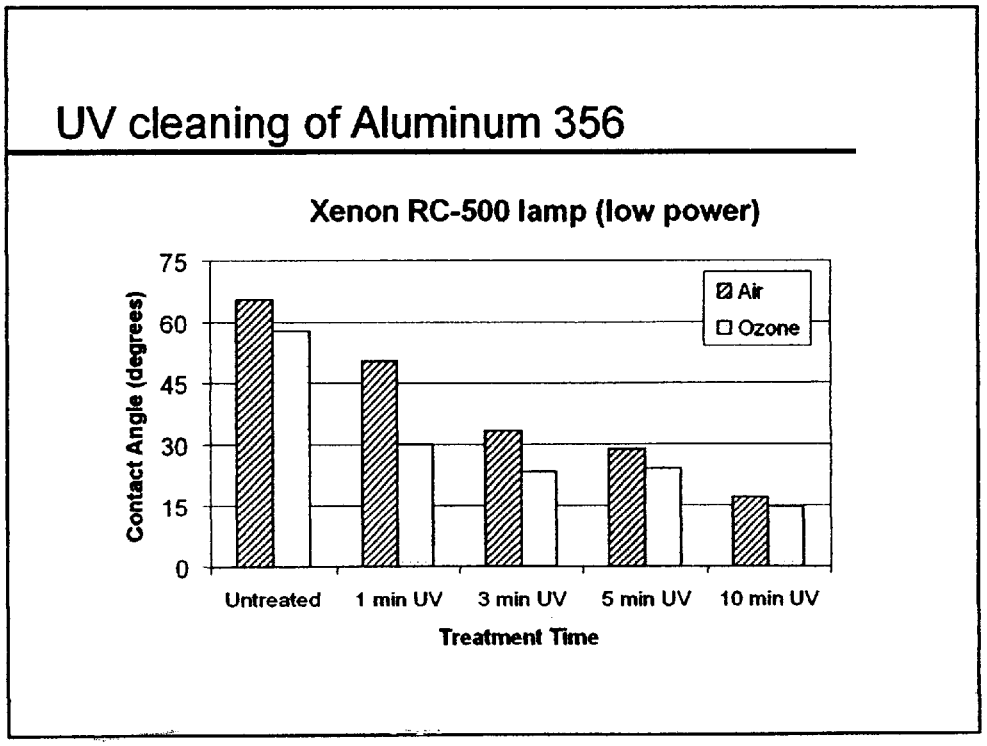
FIG. 5 is a graph showing the low power treatment of a finished metal surface of aluminum 356 with and without ozone and with a Xenon RC 500 lamp (low power ~0.5 KW).

FIGS. 4 and 5 show the results when aluminum 1100 and 356 contaminated surfaces are treated with pulsed UV light from a Xenon RC-500 lamp (low power). The output of pulsed UV light from the Xenon RC-500 is schematically shown in FIG. 3A. As can be seen in FIGS. 4 and 5, it takes 10 minutes to reduce the contact angle to an acceptable degree even in the presence of ozone.

EXAMPLE 3

Figure 3B:
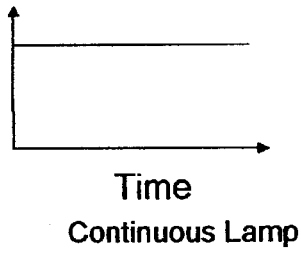
Figure 6:
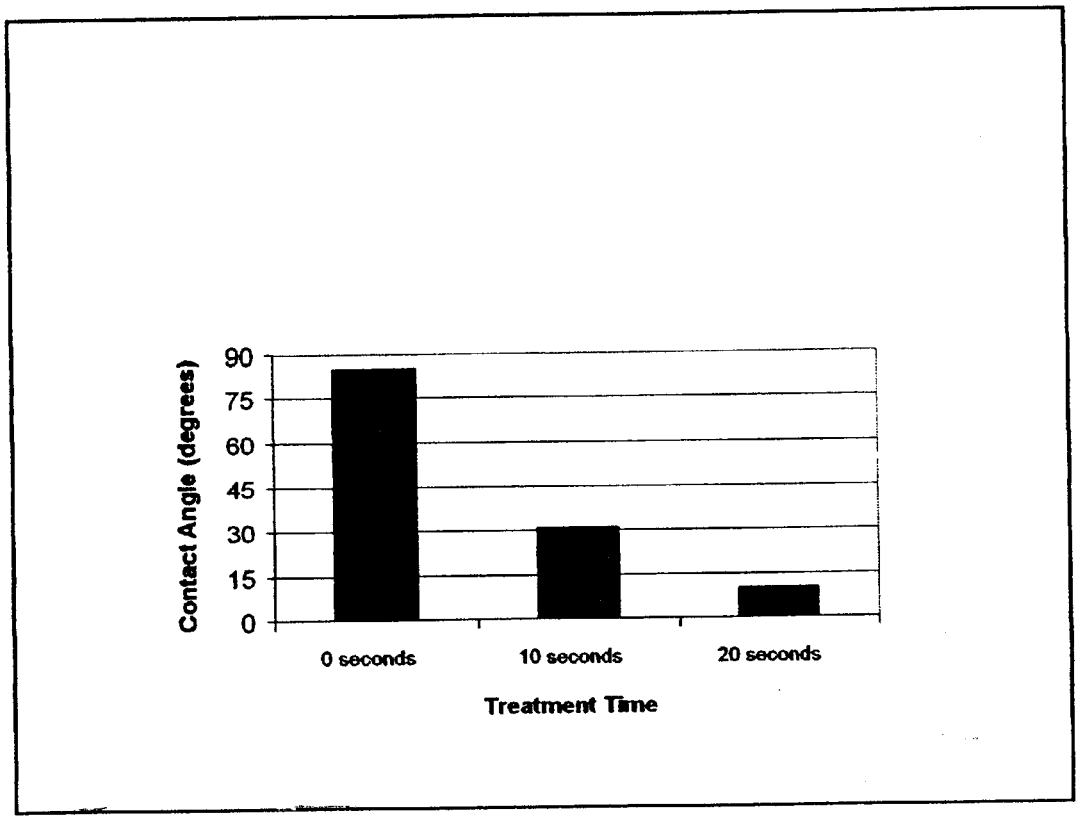
FIG. 6 is a graph showing the results of UV cleaning of aluminum 356 with a continuous UV lamp (high power (~6KW) in air.

FIG. 6 shows the results when aluminum 356 is treated with continuous UV light from a Fusion FS-600 lamp (high power). The output of continuous UV light from the Fusion FS-600 is schematically shown in FIG. 3B. As can be seen in FIG. 6, the contact angle of water is reduced to 10° or less in 20 seconds.

The result of Example 3 was achieved with other metals or polymers which are resistant to degradation as a result of exposure to the very powerful ultraviolet light. The continuous lamp was unexpectedly much more effective where time of treatment is a factor. The method was particularly effective with automotive and other vehicle wheels.

It is intended that the foregoing description be only illustrative of the present invention and that the present invention be limited only by the hereinafter appended claims.

We claim:

1. A method for cleaning a finished and polished surface of a metal automotive wheel comprising:

(a) providing the automotive wheel on a moving conveyor; and (b) exposing a contaminant from manufacture of the automotive wheel to continuous ultraviolet light produced from a mercury vapor lamp with strong wavelength emissions at 254.5 nm for 20 seconds or less to chemically bond break and volatilize the contaminant and thereby clean the surface without damaging the finished and polished surface as the automotive wheel moves on the conveyor adjacent to the ultraviolet light.

2. The method of claim 1 wherein the ultraviolet light reacts with an organic contaminant on the surface during the exposing.

3. The method of claim 1 wherein the wheel is a steel alloy.

4. The method of claim 1 wherein the wheel is magnesium or magnesium alloy.

5. The method of claim 1 wherein the wheel is aluminum or aluminum alloy.

6. The method of claim 1 wherein the contaminant on the surface is exposed to the ultraviolet light in the presence of flowing ozone gas.

* * * * *